US012297006B2

(12) United States Patent
Mei

(10) Patent No.: US 12,297,006 B2
(45) Date of Patent: May 13, 2025

(54) BUILDING BLOCK TYPE COMBINED STORAGE DEVICE

(71) Applicant: Qin Jiang, Nantong (CN)

(72) Inventor: Fangfeng Mei, Nantong (CN)

(73) Assignee: Qin Jiang, Nantong (CN)

( * ) Notice: Subject to any disclaimer, the term of this patent is extended or adjusted under 35 U.S.C. 154(b) by 0 days.

(21) Appl. No.: 17/773,623

(22) PCT Filed: Jun. 29, 2021

(86) PCT No.: PCT/CN2021/102903
§ 371 (c)(1),
(2) Date: May 2, 2022

(87) PCT Pub. No.: WO2022/222264
PCT Pub. Date: Oct. 27, 2022

(65) Prior Publication Data

US 2024/0174404 A1 May 30, 2024

(30) Foreign Application Priority Data

Apr. 20, 2021 (CN) ..... 202120808252.2

(51) Int. Cl.
*B65D 21/02* (2006.01)
*B65D 6/08* (2006.01)
(Continued)

(52) U.S. Cl.
CPC ..... *B65D 21/0223* (2013.01); *B65D 11/14* (2013.01); *B65D 11/18* (2013.01);
(Continued)

(58) Field of Classification Search
CPC ..... B65D 11/1826; B65D 21/0202; B65D 21/0223; B65D 11/18
(Continued)

(56) References Cited

U.S. PATENT DOCUMENTS 3,616,943 A * 11/1971 Brink ..... B65D 21/0235 206/508
4,775,069 A * 10/1988 Stonier ..... B65D 25/10 220/6

(Continued)

*Primary Examiner* — Steven A. Reynolds
*Assistant Examiner* — Prince Pal
(74) *Attorney, Agent, or Firm* — Hemisphere Law, PLLC; Zhigang Ma

(57) ABSTRACT

The utility model provides a building block type combined storage device, at least including any two of a large storage basket group, a small storage basket group and a lid. The large storage basket group includes a first large storage basket without a first handle and/or b second large storage basket with a first handle, wherein the small storage basket group includes 2*n first small storage baskets without a second handle and/or 2*m second small storage baskets with a second handle, and a, b, n, and m are all natural numbers greater than or equal to 1. Through the design of a first clamping groove mortise and tenon joint structure and a second clamping groove mortise and tenon joint structure, the stability of connection between the large and small storage basket groups is enhanced. The utility model has the advantages of flexible stacking and combination, reasonable and firm structure, high utilization rate and ability of self-arrangement and storage.

8 Claims, 10 Drawing Sheets

(51) Int. Cl.
*B65D 6/16* (2006.01)
*B65D 6/34* (2006.01)
*B65D 21/08* (2006.01)
*B65D 43/02* (2006.01)

(52) U.S. Cl.
CPC ..... *B65D 11/22* (2013.01); *B65D 21/0201* (2013.01); *B65D 21/083* (2013.01); *B65D 43/0202* (2013.01); *B65D 2543/00194* (2013.01)

(58) Field of Classification Search
USPC ..... 206/503, 504, 505, 508, 509
See application file for complete search history.

(56) References Cited

U.S. PATENT DOCUMENTS 5,392,915 A * 2/1995 Kalin ..... B65D 25/06 206/508
5,881,902 A * 3/1999 Ackermann ..... B65D 21/045 206/509
5,881,908 A * 3/1999 Hays ..... B65D 21/0223 220/675
6,112,896 A * 9/2000 Bal ..... B30B 15/0082 220/23.6
6,534,015 B1 * 3/2003 Viot ..... B01L 9/543 206/506
8,763,809 B2 * 7/2014 Baltz ..... B65D 21/045 206/509
8,851,287 B2 * 10/2014 Becklin ..... B65D 21/0224 108/55.3
9,108,766 B2 * 8/2015 Gosen ..... B65D 21/0233
10,583,962 B2 * 3/2020 Brunner ..... B25H 1/04
11,376,781 B2 * 7/2022 Fortenbacher ..... B65D 25/04
2004/0195139 A1 * 10/2004 Wong ..... B65D 21/062 206/509
2006/0070906 A1 * 4/2006 Verna ..... B65D 21/041 206/509
2006/0196800 A1 9/2006 Baltz
2006/0254946 A1 * 11/2006 Becklin ..... B65D 21/0223 206/508
2009/0236255 A1 * 9/2009 Piacenza ..... B65D 45/22 206/508
2010/0006467 A1 * 1/2010 Joseph ..... B65D 43/0216 206/508
2010/0219193 A1 * 9/2010 Becklin ..... B65D 21/0224 220/630
2011/0073516 A1 * 3/2011 Zelinskiy ..... B25H 3/02 206/509
2014/0367395 A1 12/2014 Newhouse et al.
2015/0021322 A1 * 1/2015 Rosenblum ..... B65D 5/4229 206/508
2015/0114959 A1 * 4/2015 Fritz ..... B62B 1/12 220/7
2017/0121056 A1 * 5/2017 Wang ..... B65D 21/0228
2018/0161975 A1 * 6/2018 Brunner ..... A45C 7/005
2018/0200876 A1 7/2018 Wolle et al.
2019/0352050 A1 * 11/2019 Ismert ..... B65D 11/1826
2020/0399026 A1 * 12/2020 Green ..... B65D 43/0212
2022/0024639 A1 * 1/2022 De Bloos ..... B65D 21/0223
2022/0242613 A1 * 8/2022 Holzleithner ..... B65D 21/0219
2022/0281639 A1 * 9/2022 Ismert ..... B65D 11/1873
2023/0136626 A1 * 5/2023 Cai ..... B25H 3/02 206/503

* cited by examiner

BUILDING BLOCK TYPE COMBINED STORAGE DEVICE

TECHNICAL FIELD

The utility model relates to a storage container, in particular to a building block type combined storage device.

BACKGROUND

At present, among various storage containers on the market, there are many individual storage containers and cabinet-type storage containers based on folding schemes. The individual storage containers solve some storage problems, which is, however, not convenient for a user to realize storage in groups according to storage units, and is also not convenient to make full use of a storage site. The cabinet-type storage containers are basically integrated and are inconvenient to move. Besides, them are only two ways to deal with the structure damage of the cabinet: one is to replace the whole container, which is costly, and the other is to continue to use the container, but the stability of the overall structure of the cabinet cannot be guaranteed.

SUMMARY

An objective of the utility model is to provide a building block type combined storage device to solve one or more of the above problems in the prior art.

The utility model provides a building block type combined storage device, at least including two of a large storage basket group, a small storage basket group and a lid, wherein the large storage basket group includes a first large storage basket without a first handle and/or b second large storage basket with a first handle, the small storage basket group includes 2*n first small storage baskets without a second handle and/or 2*m second small storage baskets with a second handle, and n, and m are all natural numbers greater than or equal to 1.

In some embodiments, the first large storage basket, the second large storage basket, the first small storage baskets and the second small storage baskets are all foldable.

In some embodiments, the first large storage basket is stacked on any one of another first large storage basket, the second large storage basket or the lid, the second large storage basket is stacked on any one of another second large storage basket, the first large storage basket or the lid, a bottom of the first large storage basket and a bottom of the second large storage basket are respectively provided with a first frame bottom, and the first handle is provided with a first auxiliary recess.

A bottom of the first frame bottom is provided with a first clamping groove mortise and tenon joint structure, the first clamping groove mortise and tenon joint structure includes a first annular protrusion and four first bumps disposed around the first annular protrusion, the first auxiliary recess is configured to embed the first bumps, outer edges of the first bumps are disposed corresponding to a first frame at a top of the first large storage basket, and the first annular protrusion is disposed corresponding to the first handle.

In some embodiments, an inner side of the first annular protrusion is provided with grid-like first reinforcing ribs.

In some embodiments, the first large storage basket corresponds to two first small storage baskets, the first large storage basket corresponds to two second small storage baskets, and the first large storage basket corresponds to one first small storage basket and one second small storage basket.

In some embodiments, the second large storage basket corresponds to two first small storage baskets, the second large storage basket corresponds to two second small storage baskets, and the second large storage basket corresponds to one first small storage basket and one second small storage basket.

In some embodiments, the first small storage basket is stacked on any one of another first small storage basket, the first large storage basket, the second large storage basket, the lid or the second small storage basket, the second small storage basket is stacked on any one of another second small storage basket, the first large storage basket, the second large storage basket, the lid or the first small storage basket, a bottom of the first small storage basket and a bottom of the second small storage basket are respectively provided with a second frame bottom, the second handle is provided with a second auxiliary recess, and the first handle is provided with a first auxiliary recess.

A bottom of the second frame bottom is provided with a second clamping groove mortise and tenon joint structure, the second clamping groove mortise and tenon joint structure includes a second annular protrusion disposed corresponding to the first handle and the second handle, strip-like protrusions disposed corresponding to the first auxiliary recess, the first frame at the top of the first large storage basket and the second handle and located on upper and lower sides of the second annular protrusion, and bump groups disposed on left and right sides of the protrusion, and the bump group includes a second bump disposed corresponding to the second auxiliary recess, the first handle and the first frame, and an arc-shaped third bump disposed corresponding to the first auxiliary recess, the second auxiliary recess and the first frame.

In some embodiments, an inner side of the second annular protrusion is provided with grid-like second reinforcing ribs.

In some embodiments, a top of the lid is provided with a first groove, the first groove is configured to embed the first clamping groove mortise and tenon joint structure at the bottom of the first frame bottom or the second clamping groove mortise and tenon joint structures at the bottoms of the two second frame bottom arranged side by side, a bottom of the lid is provided with a second groove, and the second groove is configured to embed any one of second frames at tops of the two first small storage baskets arranged side by side, the second handles at tops of the two second small storage baskets arranged side by side, the second frame at the top of one first small storage basket and the second handle at the top of one second small storage basket arranged side by side, the first handle of one second large storage basket and the first frame at the top of one first large storage basket.

The building block type combined storage device of the utility model has the following advantages.

1. The building block type combined storage device is formed in a form of stacking, so that the movement of the building block type combined storage device can be realized by separately moving components in the building block type combined storage device.
2. The stacking process is flexible. After the building block type combined storage device is formed by stacking, the structure of the building block type combined storage device is stable and beautiful, and when any of the storage baskets is damaged, the building block type combined storage device can be maintained by replacing the damaged storage basket separately, so that the maintenance cost is low.

3. The first large storage basket, the second large storage basket, the first small storage baskets and the second small storage baskets in the building block type combined storage device described in the utility model can be used by stacking or separately, which effectively improves the utilization rate, so that the building block type combined storage device described in the utility model is more practical.
4. Through the design of the first clamping groove mortise and tenon joint structure and the second clamping groove mortise and tenon joint structure, the stability of the building block type combined storage device is further enhanced.
5. The lid designed in the building block type combined storage device described in the utility model can protect against dust and assist in stacking.
6. The first large storage basket, the second large storage basket, the first small storage basket and the second small storage basket are foldable, so that the building block type combined storage device not only can be folded as a whole and also can be folded on a single layer, which facilitates reduction of a space area occupied when the building block type combined storage device is in idle, facilitates arrangement and storage and improves the effective utilization rate of the site.

DETAILED DESCRIPTION

Figure 1:
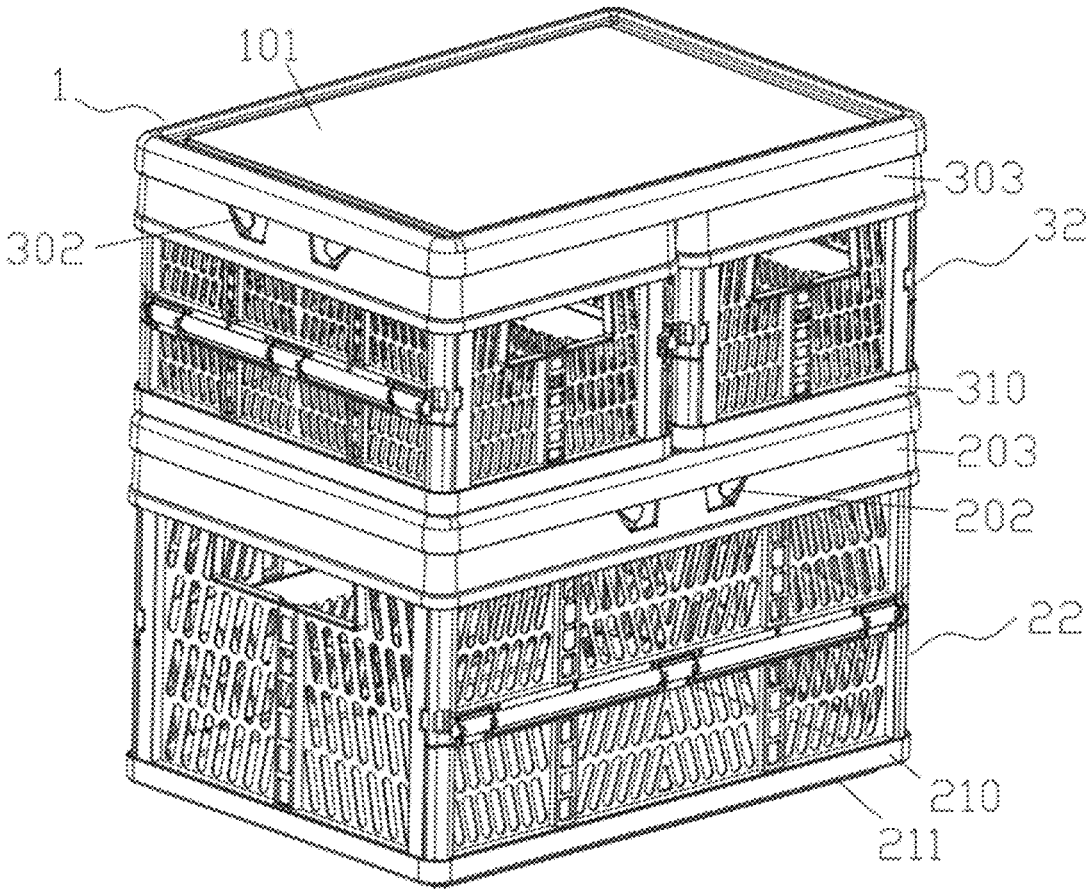
FIG. 1 is a schematic structural diagram of a building block type combined storage device formed by stacking according to Mode 1 in some embodiments of the utility model.

In combination with the contents as shown in FIG. 1 to FIG. 5 and FIG. 7, a structure of a first small storage basket and a structure of a second small storage basket in the utility model may be shown as follows.

A first small storage basket 31 includes an annular second frame 301 and a second storage basket body, and the second frame 301 is disposed at an upper port of the second storage basket body.

A second small storage basket 32 includes second handles 302, an annular fourth frame 303 and a second storage basket body, the fourth frame 303 is disposed at an upper port of the second storage basket body, and a top of the fourth frame 303 is provided with two second handles 302. One side of each second handle 302 may contact the fourth frame 303 by rotation, the two second handles 302 are arranged annularly at the moment, and the other side of each second handle 302 is provided with a second auxiliary recess 308.

A bottom of the second storage basket body is provided with a second frame bottom 310, a bottom of the second frame bottom 310 is provided with a second clamping groove mortise and tenon joint structure, and the second clamping groove mortise and tenon joint structure includes a second annular protrusion 311, strip-like protrusions 314 disposed on upper and lower sides of the second annular protrusion 311, and bump groups disposed on left and right sides of the protrusions 314. Left and right ends of the strip-like protrusions 314 have bending portions. Each bump group includes a second bump 312 and an arc-shaped third bump 313. The arc-shaped third bump 313 is are located on an outer side of the corner of the second annular protrusion 311; the strip-like protrusions 314, the third bump 313 and the second bump 312 are arranged annularly; and an outer side of the protrusion 314 is flush with an outer side of the third bump 313 on one side provided with the protrusion 314, and an outer side of the second bump 312 is flush with the outer side of the third bump 313 on one side provided with the second bump 312.

In some embodiments, the second storage basket body is foldable.

In some embodiments, an inner side of the second annular protrusion 311 is provided with grid-like second reinforcing ribs.

In combination with the contents as shown in FIG. 1 to FIG. 6, a structure of a first large storage basket and a structure of a second large storage basket involved in the utility model are as follows.

A first large storage basket 21 includes an annular first frame 201 and a first storage basket body, and the first frame 201 is disposed at an upper port of the first storage basket body.

A second large storage basket 22 includes first handles 202, an annular third frame 203 and a first storage basket body, the third frame 203 is disposed at an upper port of the first storage basket body, and a top of the third frame 203 is provided with two first handles 202. One side of the first handle 202 may contact the third frame 203 by rotation, the two first handles 202 are arranged annularly at the moment, and the other side of the first handle 202 is provided with a first auxiliary recess 208.

A bottom of the first storage basket body is provided with a first frame bottom 210, a bottom of the first frame bottom 210 is provided with a first clamping groove mortise and tenon joint structure, the first clamping groove mortise and tenon joint structure includes a first annular protrusion 211 and four first bumps 212 disposed around the first annular protrusion 211, and the four first bumps 212 are arranged annularly.

In some embodiments, the first storage basket body is foldable.

In some embodiments, an inner side of the first annular protrusion 211 is provided with grid-like first reinforcing ribs.

In combination with the contents as shown in FIG. 1 to FIG. 3, FIG. 5, FIG. 8 and FIG. 9, a structure of a lid in the utility model is as follows.

A top of the lid 1 is provided with a first groove 101, and a bottom of the lid 1 is provided with a second groove 102.

The first small storage baskets 31, the second small storage baskets 32, the first large storage basket 21 and the second large storage basket 22 may be used separately. The first small storage baskets 31, the second small storage baskets 32, the first large storage basket 21, the second large storage basket 22 and the lid 1 may also be collocated and stacked to form different building block type combined storage devices for use. The building block type combined storage device at least includes two of a large storage basket group, a small storage basket group and the lid. The large storage basket group includes a first large storage basket without a first handle and/or b second large storage basket with a first handle. The small storage basket group includes 2*n first small storage baskets without a second handle and/or 2*m second small storage baskets with a second handle, and a, b, n, and m are all natural numbers greater than or equal to 1. There are a plurality of specific collocation modes, for example:

Mode 1

Collocation mode: two second small storage baskets 32+one second large storage basket 22+two lids 1.

Figure 2:
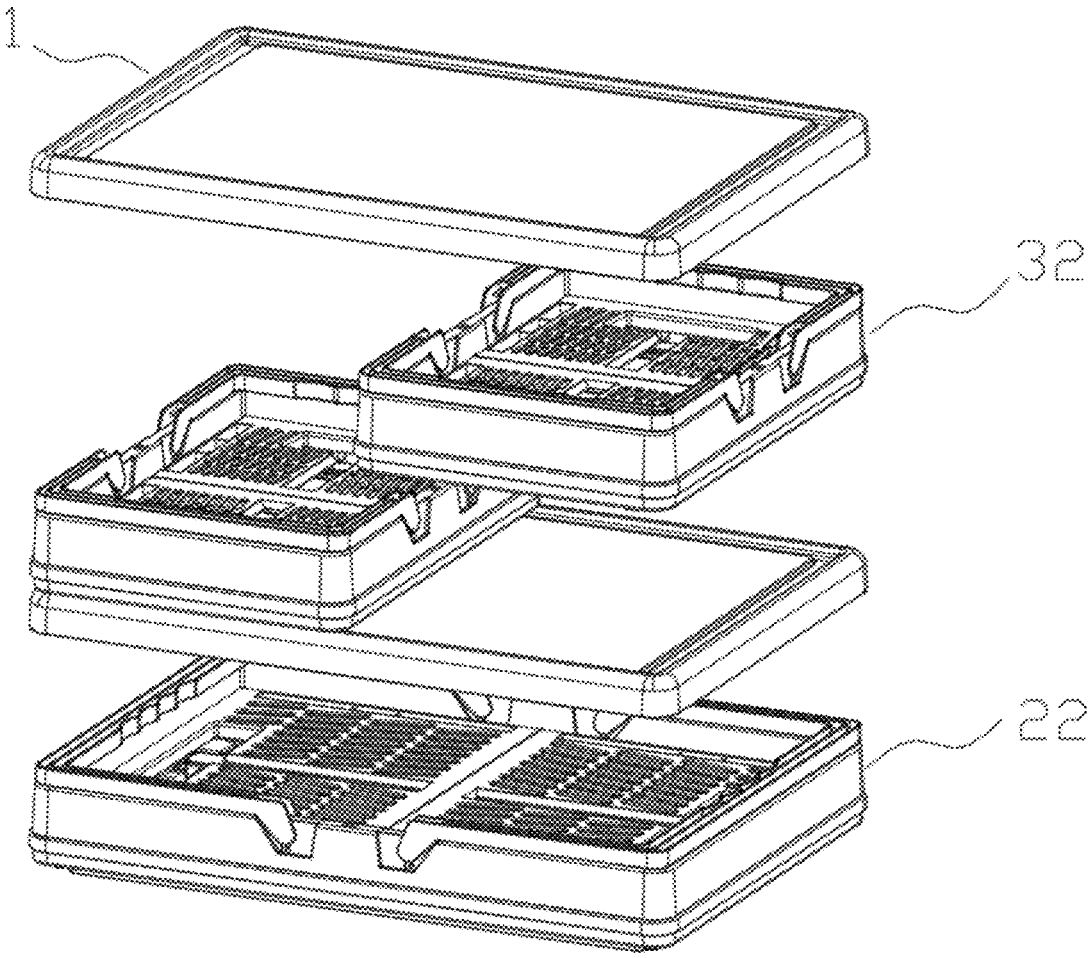
FIG. 2 is a schematic structural diagram of the building block type combined storage device formed by stacking according to Mode 1 when folded in some embodiments of the utility model.

In combination with the contents as shown in FIG. 1 and FIG. 2, a structure of the building block type combined storage device formed according to the collocation mode may be as follows: one of the lids 1 is a lid A, and the lid A covers the second large storage basket 22. At the moment, one side of the first handle 202 is in contact with the third frame 203, and the first handle 202 is embedded in the second groove 102 in the bottom of the lid A.

The other lid 1 is a lid B, and the lid B covers the two second small storage baskets 32 arranged side by side. A width direction of the two second small storage baskets 32, a length direction of the second large storage basket 22 and a length direction of the two lids 1 are the same. An outer edge of the second small storage basket 32 is in contact with an outer edge of the other second small storage basket 32. The fourth frames 303 on the two second small storage baskets 32 are embedded in the second groove 102 in the bottom of the lid B. The second clamping groove mortise and tenon joint structures on the two second small storage baskets 32 are embedded in the first groove 101 in the top of the lid A.

The structure of the building block type combined storage device formed by stacking according to the collocation mode when being folded is shown in FIG. 2.

The lids can play the role of dust control.

Mode 2

Collocation mode: two second small storage baskets 32+one second large storage basket 22+one lid 1.

Figure 3:
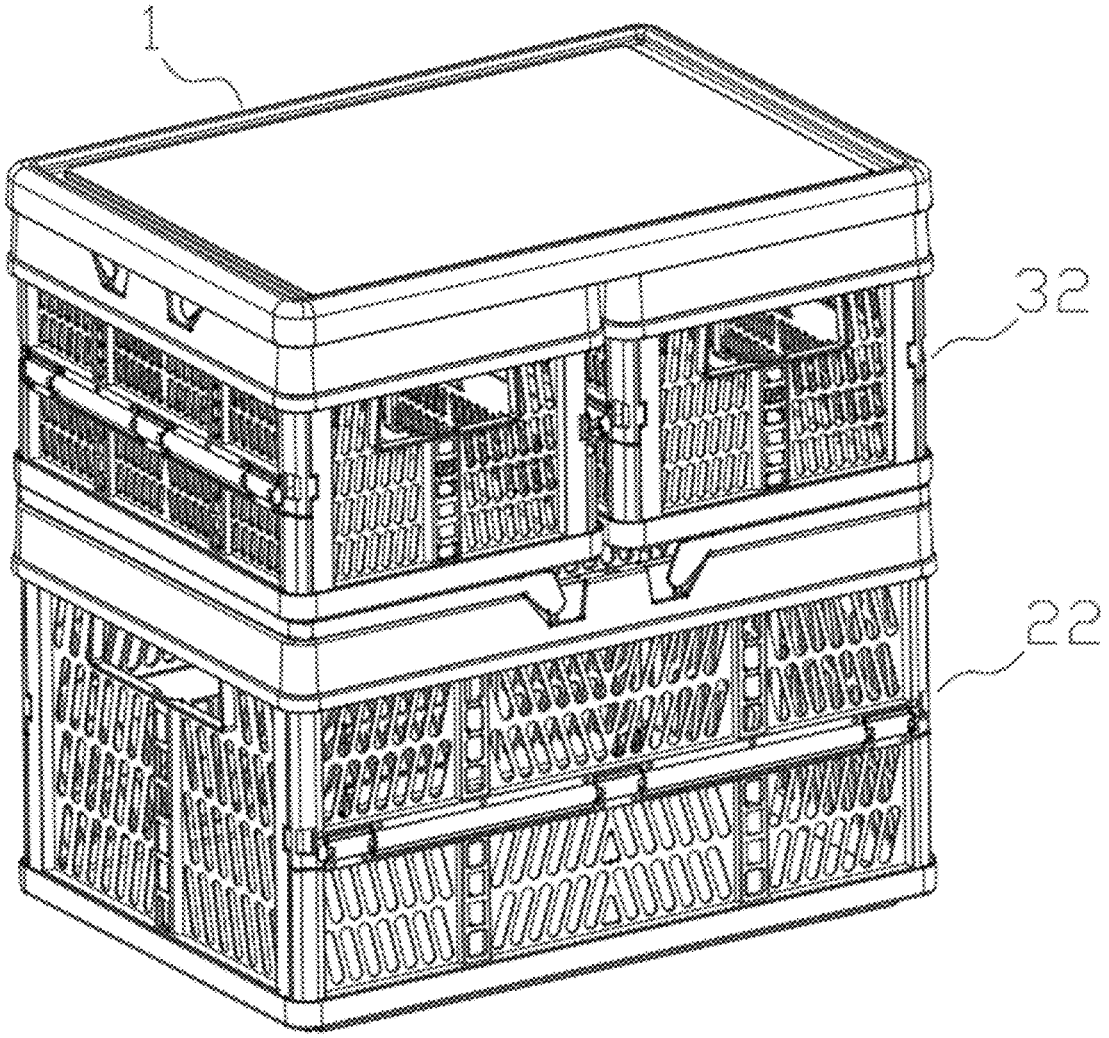
FIG. 3 is a schematic structural diagram of a building block type combined storage device formed by stacking according to Mode 2 in some embodiments of the utility model.

In combination with the contents as shown in FIG. 3, a structure of the building block type combined storage device formed according to the collocation mode may be as follows.

The lid 1 covers the two second small storage baskets 32 arranged side by side. The two second small storage baskets 32 are stacked on the second large storage basket 22. A width direction of the two second small storage baskets 32, a length direction of the second large storage basket 22 and a length direction of the lid 1 are the same. An outer edge of the second small storage basket 32 is in contact with an outer edge of the other second small storage basket 32. The fourth frames 303 on the two second small storage baskets 32 are embedded in the second groove 102 in the bottom of the lid 1. The two second small storage baskets 32 are stacked on the second large storage basket 22. The strip-like protrusion 314 at the bottom of one side of the second small storage basket 32, which is not in contact with the other second small storage basket 32, and the third bumps 313 at two ends of the strip-like protrusion 314 are embedded in first auxiliary recesses 208 in the first handles 202. The rest of the second clamping groove mortise and tenon joint structure is embedded in an inner side of an annular structure formed by the two first handles 202.

If the second large storage basket 22 is replaced by the first large storage basket 21, then the second clamping groove mortise and tenon joint structures at the bottoms of the two second small storage baskets 32 are embedded in the inner side of the first frame 201 on the first large storage basket 21.

Mode 3

Collocation mode: two second small storage baskets 32+one second large storage basket 22.

Figure 4:
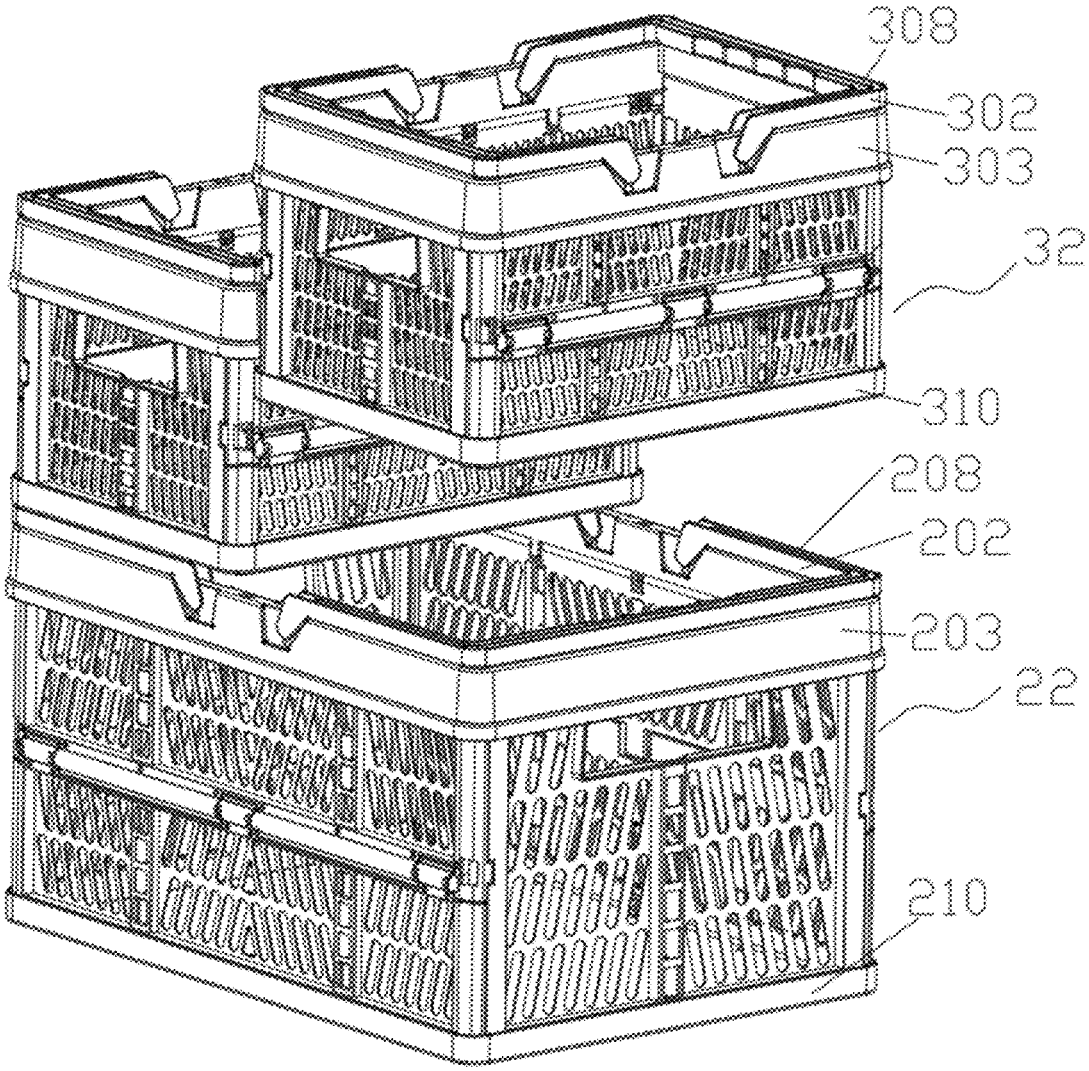
FIG. 4 is a schematic structural diagram of a building block type combined storage device formed by stacking according to Mode 3 in some embodiments of the utility model.

In combination with the contents as shown in FIG. 4, a structure of the building block type combined storage device formed according to the collocation mode may be as follows.

The two second small storage baskets 32 are stacked on the second large storage basket 22. A width direction of the two second small storage baskets 32 and a length direction of the second large storage basket 22 are the same. An outer edge of the second small storage basket 32 is in contact with an outer edge of the other second small storage basket 32. The fourth frames 303 on the two second small storage baskets 32 are embedded in the second groove 102 in the bottom of the lid 1. The two second small storage baskets 32 are stacked on the second large storage basket 22, and the strip-like protrusion 314 at the bottom of one side of the second small storage basket 32, which is not in contact with the other second small storage basket 32, and the third bumps 313 at two ends of the strip-like protrusion 314 are embedded in the first auxiliary recesses 208 in the first handles 202. The rest of the second clamping groove mortise and tenon joint structure is embedded in an inner side of an annular structure formed by the two first handles 202.

Mode 4

Collocation mode: two first small storage baskets 31+two second small storage baskets 32+two lids 1+one first large storage basket 21+one second large storage basket 22.

Figure 5:
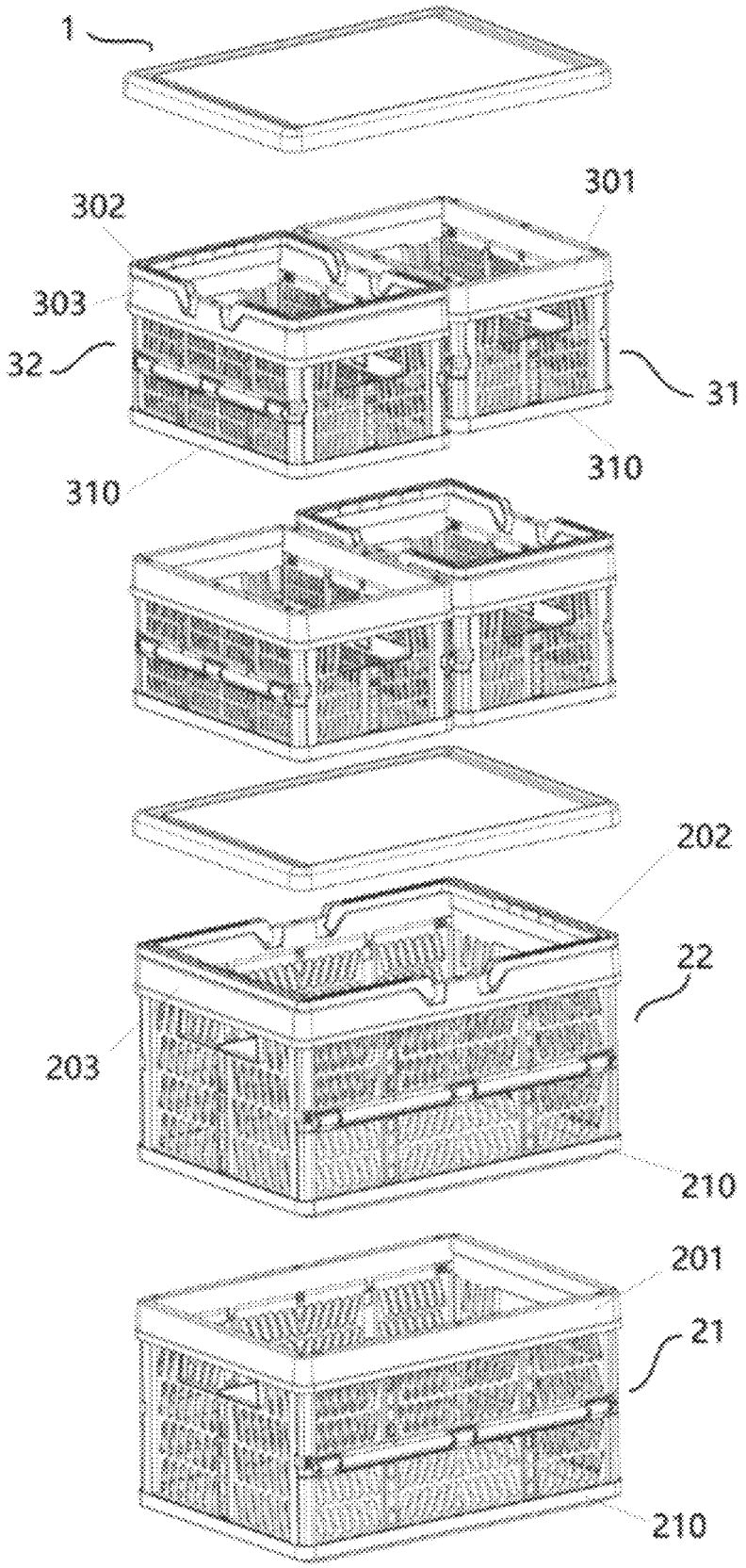
FIG. 5 is a schematic structural diagram of a building block type combined storage device formed by stacking according to Mode 4 in some embodiments of the utility model.
Figure 6:
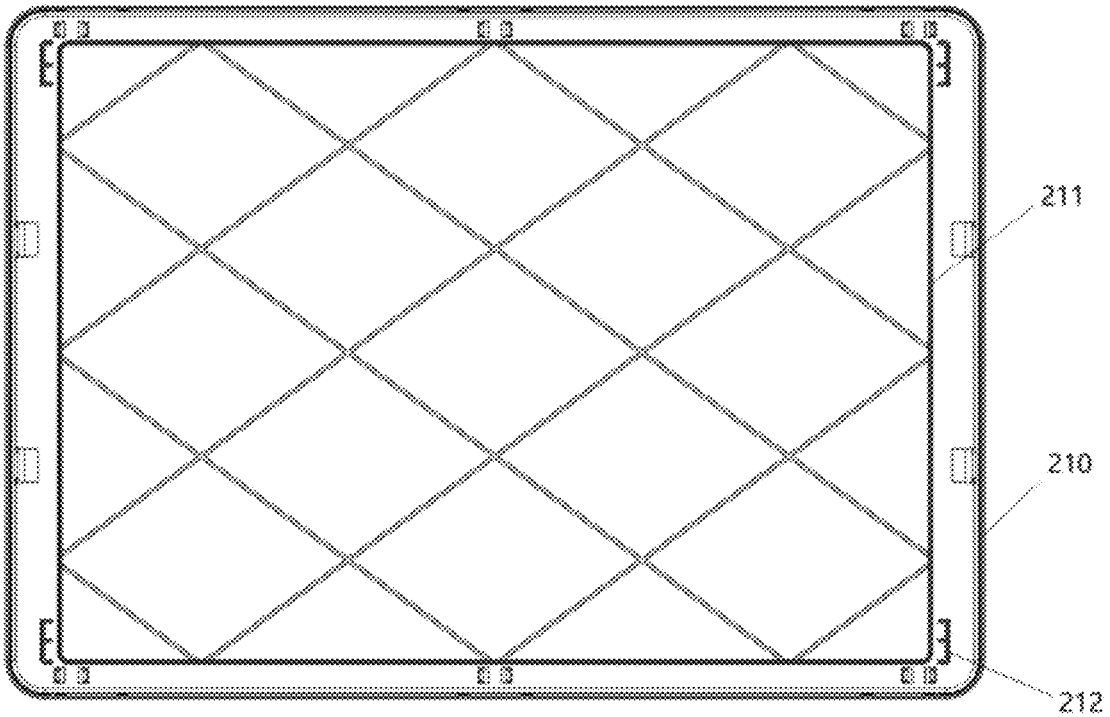
FIG. 6 is a bottom view of a first frame bottom in some embodiments of the utility model.
Figure 7:
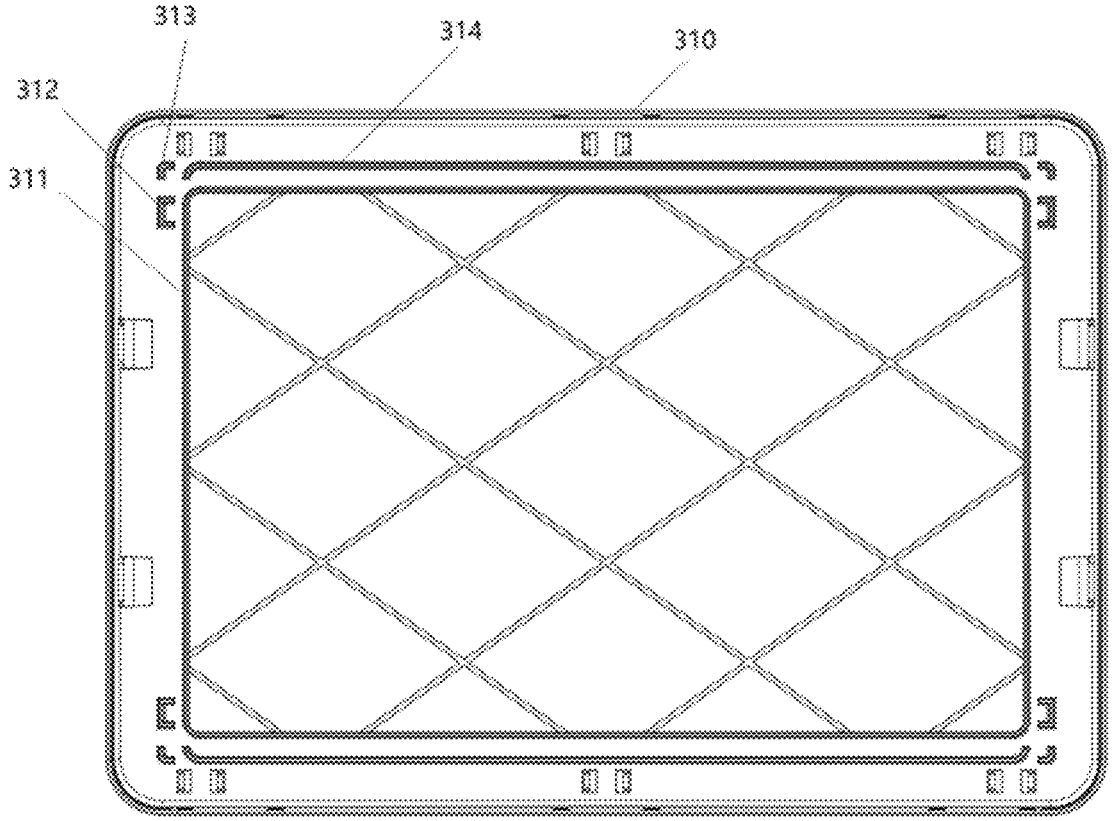
FIG. 7 is a bottom view of a second frame bottom in some embodiments of the utility model.
Figure 8:
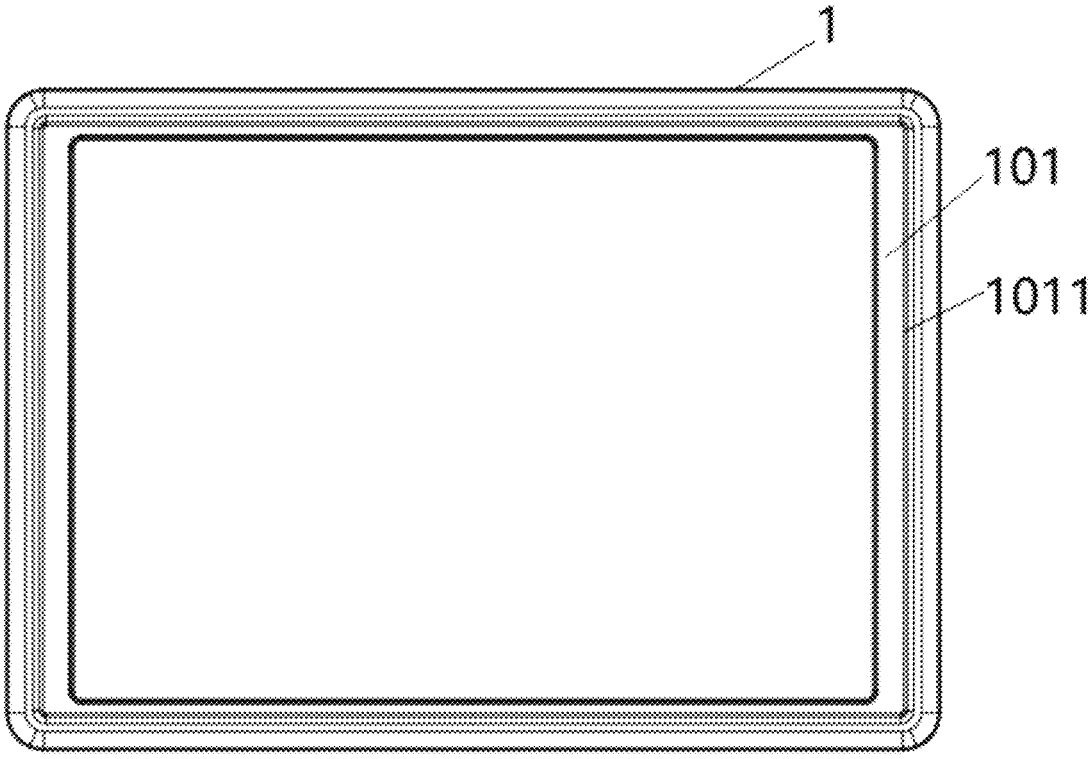
FIG. 8 is a top view of a lid in some embodiments of the utility model.
Figure 9:
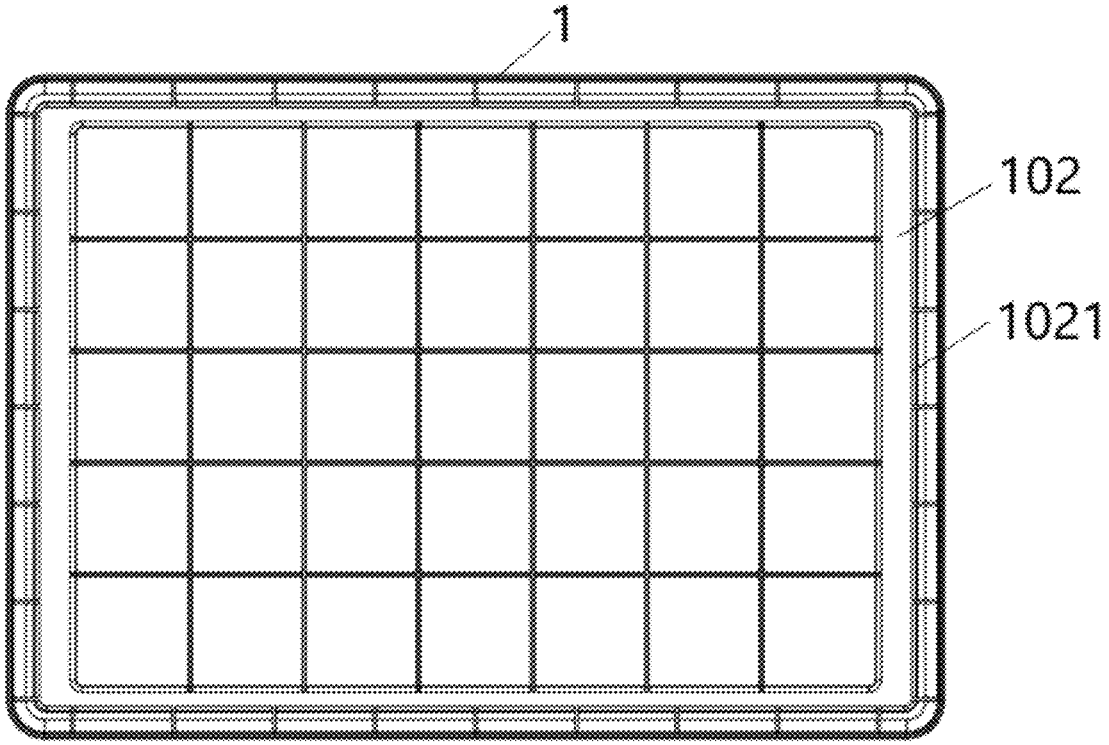
FIG. 9 is a bottom view of the lid in some embodiments of the utility model.

In combination with the contents as shown in FIG. 5, a structure of the building block type combined storage device formed according to the collocation mode may be as follows.

The two first small storage baskets 31 are respectively a first small storage basket A and a first small storage basket B, the two second small storage baskets 32 are respectively a second small storage basket A and a second small storage basket B, one side of each second handle 302 on the two second small storage baskets 32 is in contact with an upper surface of the fourth frame 303, and the two lids 1 are respectively a lid C and a lid D. A width direction of the two first small storage baskets 31, a width direction of the two second small storage baskets 32, a length direction of the two lids 1, a length direction of the first large storage basket 21 and a length direction of the second large storage basket 22 are the same.

The first small storage basket A is stacked on the second small storage basket A. The second annular protrusion 311 and the two protrusions 314 at the bottom of the first small storage basket A are embedded in an inner side of an annular structure formed by the two second handles 302 on the second small storage basket A. The bump groups are embedded in the second auxiliary recesses 308.

The second small storage basket B is stacked on the first small storage basket B, and the second clamping groove mortise and tenon joint structure at the bottom of the second small storage basket B is embedded in the inner side of the second frame 301.

One side of the first small storage basket A is in contact with one side of the first small storage basket B. The top of the first small storage basket A and the top of the first small storage basket B are flush with each other and are both embedded in the second groove 102 in the bottom of the lid C. The second clamping groove mortise and tenon joint structure at the bottom of the second small storage basket A and the second clamping groove mortise and tenon joint structure at the bottom of the second small storage basket B are embedded in the first groove 101 in the top of the lid D. The first handles 202 at the top of the second large storage basket 22 are embedded in the second groove 102 in the bottom of the lid D.

The second large storage basket 22 is stacked on the first large storage basket 21, and the four first bumps 212 at the bottom of the second large storage basket 22 are embedded in the inner side of the first frame 201.

In some embodiments, when the first large storage basket 21 or the second large storage basket 22 is stacked on the two small storage baskets (the two small storage baskets may be in any situation of the two first small storage baskets 31, or the two second small storage baskets 32, or the first small storage basket 31 and the second small storage basket 32 whose upper surfaces are flush with each other), the lid 1 may be placed on the two small storage baskets as a transition, and then the first large storage basket 21 or the second large storage basket 22 is stacked on the lid 1.

Figure 10:
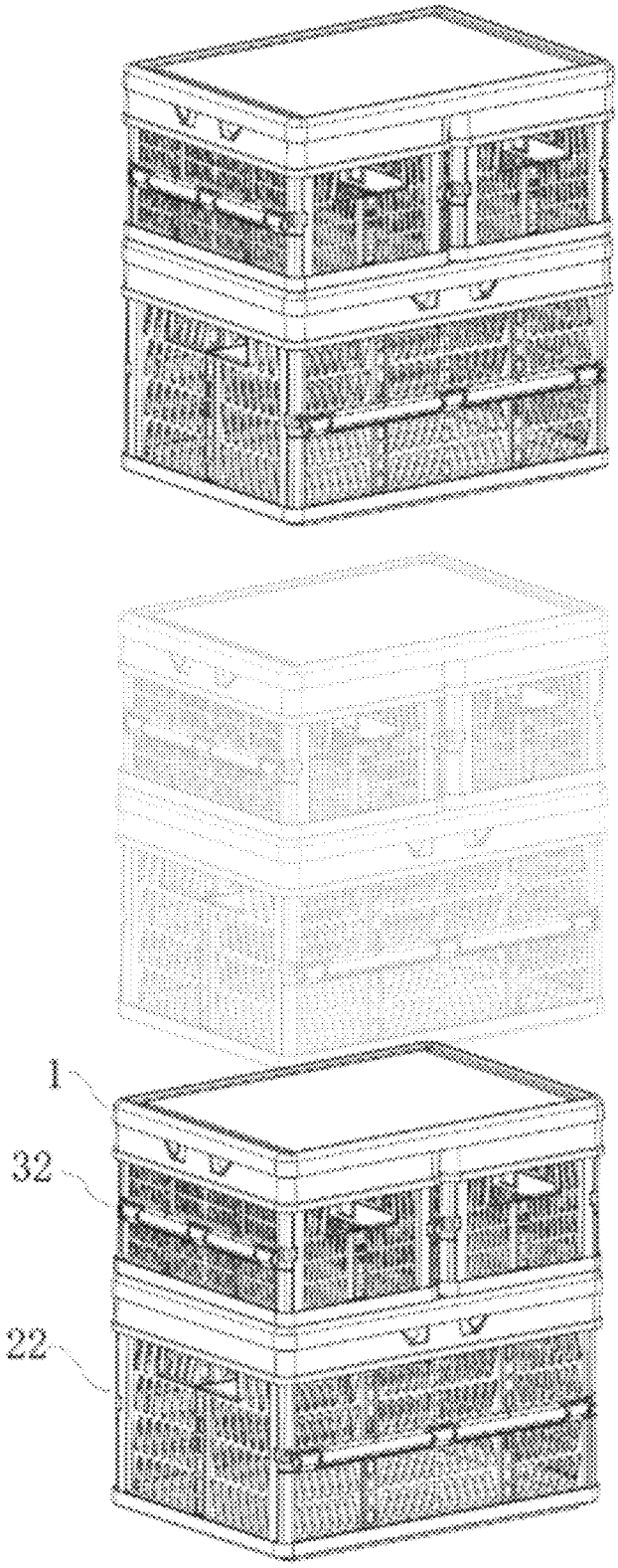
FIG. 10 is a schematic structural diagram of a building block type combined storage device formed by infinite stacking according to Mode 1 in some embodiments of the utility model.

In combination with the contents as shown in FIG. 10, users may stack the storage baskets according to their own needs, and may further continuously stack the storage baskets layer by layer according to needs (the number of layers is not limited). For example, the storage baskets are infinitely stacked upward according to Mode 1 to form the building block type combined storage device. The specific stacking and collocation mode is not limited to the collocation modes described in detail above.

The above description is only preferred modes of the utility model. It should be noted that those of ordinary skill in the art can make several similar modifications and improvements without departing from the inventive concept of the utility model, which should also be regarded to be within the protection scope of the utility model.

The invention claimed is:

1. A building block type combined storage device, characterized by at least comprising:

a large storage basket group, a small storage basket group and a lid (1), wherein the large storage basket group comprises at least one first large storage basket (21) without a first handle (202) and at least one second large storage basket (22) with a first handle (202), the small storage basket group comprises 2*n first small storage baskets (31) without a second handle (302) and/or 2*m second small storage baskets (32) with a second handle (302), and n and m are all natural numbers greater than or equal to 1;

wherein, one of the at least one first large storage basket (21) is stacked on any one of another first large storage basket (21), the at least one second large storage basket (22) or the lid (1), one of the at least one second large storage basket (22) is stacked on any one of another second large storage basket (22), the at least one first large storage basket (21) or the lid (1), a bottom of each first large storage basket (21) and a bottom of each second large storage basket (22) are respectively provided with a first frame bottom (210), the first handle (202) is provided with a first auxiliary recess (208), and a bottom of the first frame bottom (210) is provided with a first clamping groove mortise and tenon joint structure, the first clamping groove mortise and tenon joint structure comprises a first annular protrusion (211) and four first bumps (212) disposed around the first annular protrusion (211), the first auxiliary recess (208) is configured to embed the first bumps (212), outer edges of the first bumps (212) are disposed corresponding to a first frame (201) at a top of a corresponding one of the at least one first large storage basket (21), and the first annular protrusion (211) is disposed corresponding to the first handle (202).

2. The building block type combined storage device according to claim 1, characterized in that the at least one first large storage basket (21), the at least one second large storage basket (22), the first small storage baskets (31) and the second small storage baskets (32) are all foldable.

3. The building block type combined storage device according to claim 1, characterized in that an inner side of the first annular protrusion (211) is provided with grid-like first reinforcing ribs.

4. The building block type combined storage device according to claim 1, characterized in that one of the at least one first large storage basket (21) corresponds to two first small storage baskets (31), one of the at least one first large storage basket (21) corresponds to two second small storage baskets (32), or one of the at least one first large storage basket (21) corresponds to one of the first small storage basket (31) and one of the second small storage basket (32).

5. The building block type combined storage device according to claim 1, characterized in that one of the at least one second large storage basket (22) corresponds to two first small storage baskets (31), one of the at least one second large storage basket (22) corresponds to two second small storage baskets (32), or one of the at least one second large storage basket (22) corresponds to one first small storage baskets (31) and one second small storage baskets (32).

6. The building block type combined storage device according to claim 1, characterized in that one of the first small storage baskets (31) is stacked on any one of another first small storage basket (31), one of the at least one first large storage basket (21), one of the at least one second large storage basket (22), the lid (1) or one of the second small storage baskets (32), one of the second small storage baskets (32) is stacked on any one of another second small storage basket (32), one of the at least one first large storage basket (21), one of the at least one second large storage basket (22), the lid (1) or one of the first small storage baskets (31), a bottom of each first small storage basket (31) and a bottom of each second small storage basket (32) are respectively provided with a second frame bottom (310), the second handle (302) is provided with a second auxiliary recess (308), the first handle (202) is provided with the first auxiliary recess (208), a bottom of the second frame bottom (310) is provided with a second clamping groove mortise and tenon joint structure, the second clamping groove mortise and tenon joint structure comprises a second annular protrusion (311) disposed corresponding to the first handle (202) and the second handle (302), strip-like protrusions (314) disposed corresponding to the first auxiliary recess (208), the first frame (201) at the top a corresponding one of the at least one first large storage basket (21) and the second handle (302) and located on upper and lower sides of the second annular protrusion (311), and bump groups disposed on left and right sides of the protrusion (314), and the bump group comprises a second bump (312) disposed corresponding to the second auxiliary recess (308), the first handle (202) and the first frame (201), and an arc-shaped third bump (313) disposed corresponding to the first auxiliary recess (208), the second auxiliary recess (308) and the first frame (201).

7. The building block type combined storage device according to claim 6, characterized in that an inner side of the second annular protrusion (311) is provided with grid-like first reinforcing ribs.

8. The building block type combined storage device according to claim 6, characterized in that a first groove (101) is formed in a top of the lid (1), the first groove (101) is configured to embed the first clamping groove mortise and tenon joint structure at the bottom of the first frame bottom (210) or the second clamping groove mortise and tenon joint structures at the bottoms of the two second frame bottoms (310) arranged side by side, a second groove (102) is formed in a bottom of the lid (1), and the second groove (102) is configured to embed any one of second frames (301) at tops of the two first small storage baskets (31) arranged side by side, the second handles (302) at tops of the two second small storage baskets (32) arranged side by side, the second frame (301) at the top of one first small storage basket (31) and the second handle (302) at the top of one second small storage basket (32) arranged side by side, the first handle (202) of one of the at least one second large storage basket (22) and the first frame (201) at the top of one of the at least one first large storage basket (21).

* * * * *